United States Patent [19]

Olivier

[11] Patent Number: 4,738,321

[45] Date of Patent: Apr. 19, 1988

[54] PROCESS AND APPARATUS FOR VERTICAL RACKING OF DRILLING SHAFTS ON A DRILLING TOWER

[75] Inventor: Dantan Olivier, Bauguenais, France

[73] Assignee: Brissonneau et Lotz Marine, Zone Industrielle, France

[21] Appl. No.: 886,257

[22] Filed: Jul. 15, 1986

[30] Foreign Application Priority Data

Jul. 19, 1985 [FR] France ..... 85 11059

[51] Int. Cl.[4] ..... E21B 19/14

[52] U.S. Cl. ..... 175/85; 414/22

[58] Field of Search ..... 175/52, 85; 166/77.5, 166/85; 414/22, 745

[56] References Cited

U.S. PATENT DOCUMENTS

| | | | |
|---|---|---|---|
| 3,633,767 | 1/1972 | Mitchell et al. | 414/22 |
| 3,987,910 | 10/1976 | Brunato | 175/85 |
| 4,044,895 | 8/1977 | Adair | 175/85 |
| 4,117,941 | 10/1978 | McCleskey, Jr. et al. | 414/22 |
| 4,269,554 | 5/1981 | Jackson | 414/22 |
| 4,274,777 | 6/1981 | Seaggs | 414/22 |
| 4,274,778 | 6/1981 | Putnam et al. | 414/22 |
| 4,531,875 | 7/1985 | Krueger | 414/22 |

*Primary Examiner*—Stephen J. Novosad
*Assistant Examiner*—Hoang C. Dang
*Attorney, Agent, or Firm*—Rines and Rines, Shapiro and Shapiro

[57] ABSTRACT

The invention concerns a process and an installation for vertical racking of drill shafts on a drilling tower. The installation comprises mechanisms (34, 36, 38, 40) to grasp an upper intermediate portion of an assembly (26) of shaft sections removed from the well bore, and to incline this shaft assembly with respect to vertical below lifting mechanisms (16, 18). The installation further includes mechanisms (42, 44, 46, 48, 50) to receive and support the lower end of the shaft assembly and then displace the assembly in synchronization with the first mentioned mechanisms to transport the assembly to racks for vertical storage.

5 Claims, 8 Drawing Sheets

PROCESS AND APPARATUS FOR VERTICAL RACKING OF DRILLING SHAFTS ON A DRILLING TOWER

The invention concerns a process and an apparatus for vertical racking of drilling shafts on a drilling power, for example in the drilling of a well for extraction of petroleum.

A drilling tower, or "derrick," is equipped with elevating mechanisms to lower and raise within a drilled well, a train of shafts or tubes whose lower end is equipped with a digging tool, such as a trepan. Since such tools wear very rapidly during drilling, it is necessary to change them very often. To accomplish this, it is necessary to raise the entire train of shaft sections which has been lowered into the bore, and then to lower the train of shaft, after replacement of the tool. These shaft trains can have very substantial lengths, of several hundred or thousands of meters, and thus it is necessary to disassemble the shaft sections of the train during their exit from the bore when the shaft train is raised, and to reattach them end to end during relowering of the shaft train into the bore.

These shaft sections in general have a length of 9 meters, and are mounted end to end by screwing. To gain time, when a shaft train is raised to change the tool at its lower end, it is customary not to disassemble and reassemble the shaft sections one by one, but rather three by three.

For this, the lifting mechanism of the drilling tower grips the upper end of the shaft train at the level of the base of the drilling tower and raises the shaft train by a length of three shaft sections. The shaft train is blocked at the exit from the bore, and the lower end of the third shaft section is unscrewed from the upper end of the fourth shaft section of the shaft train. There thus results an assembly of three shaft sections screwed to one another, which is called a "triple," which is suspended by means of the lifting mechanism above the base of the drilling tower. The tower incorporates a walkway situated about 27 meters above the base, on which there stands a man responsible for catching the upper portion of the triple with cables, and pushing it by hand toward a rack having receiving emplacements for the upper ends of the triples.

Simultaneously, the lower end of the triple which is suspended by the raising mechanism, is pushed by hand by men positioned on the base of the drilling tower, toward an emplacement of another rack provided on the base. The lifting mechanism is then lowered to allow the triple to rest upon the lower rack, and then the lifting mechanism is detached from the upper end of the triple, to be connected to the upper end of the shaft train resting on the base, in order to raise it in turn by a length of three shaft sections, and so forth.

The various triples are thus stored in an essentially vertical position in the racks of the drilling tower.

When the shaft train is reconstructed to be lowered into the bore, the operations cited above are executed in reverse order; that is, each triple is grasped at its upper end by the lifting mechanism, is removed from the racks, and is pushed by hand toward the axis of the bore, after which its lower end can be screwed to the upper end of the shaft train at the exit of the bore.

Because the triples have a length of 27 meters and a weight of from one to several tons, it is understood that the operations carried out by the man positioned on the walkway and by the men on the base of the drilling tower are extremely strenuous and dangerous.

The invention has as its object a process and an apparatus enabling mechanization and automation of the operations of vertical racking of shaft sections, or assemblies of three shaft sections, in a drilling tower.

The invention, to this end, proposes a process of vertical racking of drill shaft sections in the racks of a drilling tower, which comprises extracting from the well bore an assembly of n shaft sections screwed end to end, detaching this assembly of shaft sections from the shaft train remaining with the bore, and displacing it laterally to bring its lower and upper end into corresponding lower and upper rack emplacements provided on the drilling tower, characterized in that when the assembly of shaft sections suspended by the lifting mechanism is detached from the shaft train, an intermediate upper portion of the set of shaft sections is grasped by an automatic pincer, the pincer is displaced to incline obliquely the assembly of shaft sections suspended from the lifting mechanism and to bring its lower end above a supporting carriage, the assembly of shaft sections is lowered obliquely and its lower end is supported on the said carriage, assembly of shaft sections is freed from the lifting mechanism, the automatic pincer is displaced to return the assembly of shaft sections to vertical on the said carriage, the automatic pincer and the carriage are displaced simultaneously to transport the assembly of shaft sections and position its ends in desired emplacements of the upper and lower rack of the drilling tower, and the automatic pincer and the carriage are disengaged from the shaft assembly so that the assembly is deposited in the racks.

This process according to the invention thus enables placement in the racks of the drilling tower of assemblies of shaft sections as they are extracted from the bore and detached from the shaft train remaining within the bore, without these operations necessitating manual intervention.

According to another characteristic of the process according to the invention, when the assembly of shaft sections suspended by the lifting mechanism is brought to the oblique position, an intermediate lower portion of the assembly is automatically engaged within a fixed retainer and guide, within which the shaft section assembly can be made to slide by lowering the lifting mechanism.

This ensures precise guidance of the shaft section assembly and precise positioning of its lower end above the base of the drilling tower.

According to yet another characteristic of the invention, by lowering of the assembly of shaft sections by with the lifting mechanism, the lower end of this assembly is placed upon a support, a fork-shaped cradle provided on the carriage is engaged around the lower end of the shaft section assembly, below an enlargement of this lower end, the cradle is raised with respect to the carriage to disengage the shaft section assembly from the support, and the above-cited retaining and guiding mechanism is opened to release the shaft section assembly.

With the lifting mechanism detached from the upper end of the shaft section assembly, it is thus sufficient to displace simultaneously the automatic pincer gripping the upper portion of the shaft section assembly, and the carriage bearing the lower end of this assembly, in order to bring the shaft section assembly to the desired emplacements of the holding racks.

The operations of this process are executed in reverse order to bring a shaft section assembly from the holding racks to the bore.

The invention also proposes an apparatus for vertical racking of drill shaft sections on a drilling tower, comprising a lifting mechanism to raise and lower a shaft train within the drill bore, mechanisms for screwing and unscrewing shaft section ends to and from one another, and upper and lower holding racks on the drilling tower to receive the ends of assemblies of n shaft sections screwed to one another, characterized in that it includes mechanisms at the level of each rack to grasp and support an assembly of n shaft sections and to move it between the axis of the bore and the holding racks. The mechanisms provided at the level of the lower rack comprise a carriage equipped with a cradle for support of the lower end of the assembly of n shaft sections, and mechanisms for displacement of this carriage in a horizontal plane. The mechanims provided at the level of the upper rack include a telescopic horizontal arm equipped with an automatic pincer suitable for grasping an upper intermediate portion of the shaft assembly and mechanisms for control of this arm to displace the pincer in a horizontal plane, in order, during a first time period, to incline the shaft assembly suspended by the lifting mechanism, and, in a second time period, to displace the upper portion of the shaft assembly, freed from the lifting mechanism, in synchronization with the carriage supporting the lower end of this assembly, to bring the assembly to the storage racks.

According to another characteristic of the invention, the lower carriage incorporates means, such as a hydraulic jack, for vertical displacement of the cradle with respect to the carriage.

It is of advantage that the carriage be connected by a telescoping arm to a movable platform rotating around a vertical axis.

Likewise, the upper telescoping arm bearing the automatic pincer is preferably mounted on a movable platform rotating around a vertical axis.

The two platforms are likewise movable in translation in a determined direction, which permits easy access to the various emplacements of the storage racks.

The installation according to the invention is also characterized by a fixed apparatus comprising mechanisms for grasping and guidance of a lower intermediate portion of the shaft assembly when it is in an inclined position below the lifting mechanism, and mechanisms for control of the opening of the grasping mechanism.

In the following description, given by way of example, reference will be made to the appended drawings, in which.

Figure 1:
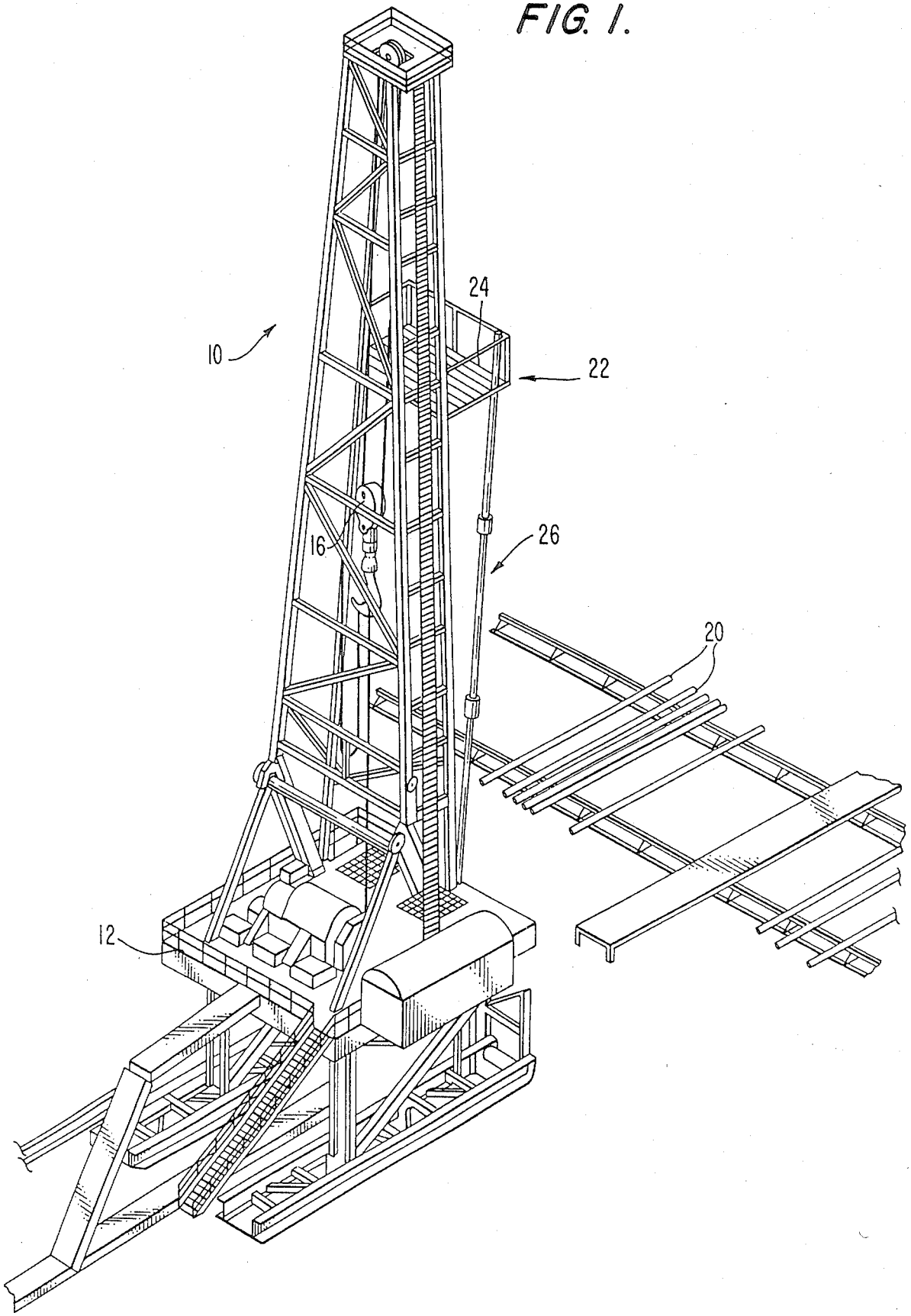
FIG. 1 is a schematic perpsective view of a drilling tower.
Figure 2:
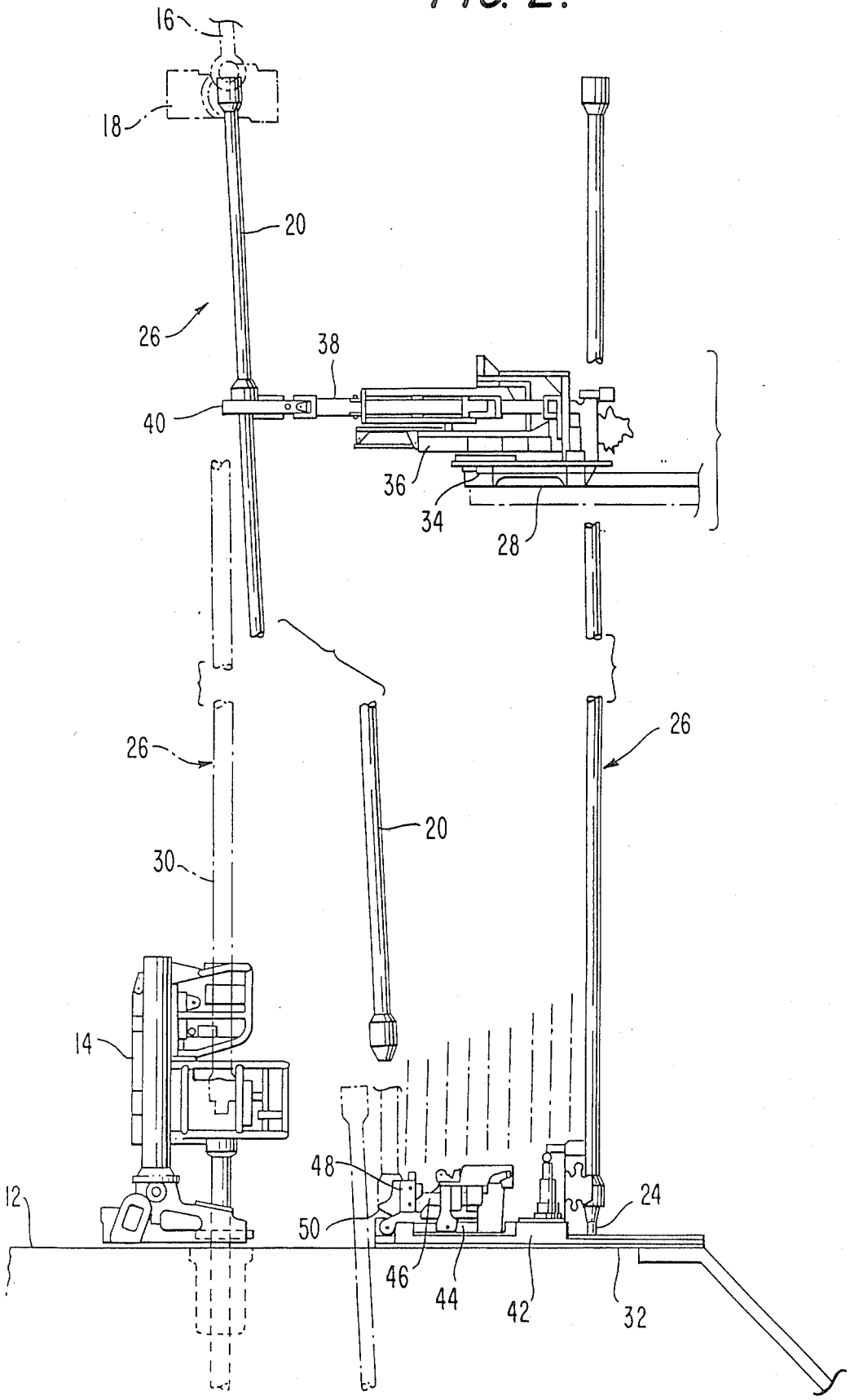
FIG. 2 represents, schematically, a surface view of a racking apparatus according to the invention.

Referring now to FIGS. 1 and 2, schematically representing a drilling tower and the installation according to the invention, the drilling tower 10 of FIG. 1 comprises a raised floor 12 supporting in particular the machines 14 for screwing and unscrewing the shaft sections end to end in the vertical position, while the means for blocking and unblocking the upper end of the shaft train are within the bore. The shaft train is raised and lowered vertically within the bore by lifting mechanisms 16 borne by the tower 10, and comprising mechanisms 18, allowing grasping of the end boss of a drilling shaft section 20.

These lifting mechanisms 16 enable raising of the upper end of an assembly of drilling shaft section above a walkway 22 located about 27 meters above the floor 12, and comprising one or more racks 24 (FIG. 3) for receiving the upper ends of the assemblies 26 of three shaft sections screwed end to end, for vertical storage of these shaft assemblies or triples on the drilling tower.

The racks 24 provided at the level of the walkway take the form of combs which face one another, separated by a roller track 28 oriented toward the drilling axis 30, upon which move the upper mechanisms for grasping and racking of triples, which will be described in detail below.

Racks corresponding to the racks 24 of the upper level are provided on the floor 12 of the drilling tower, to receive and support the lower ends of the triples 26 in the storage position. Like the racks 24 of the upper level, the racks provided on the floor 12 are separated by the roller track 32 of the mechanisms for support and transport of the lower end of the triples, with this roller track being parallel to, and vertically aligned with, the corresponding roller track 28 of the upper level.

Figure 3:
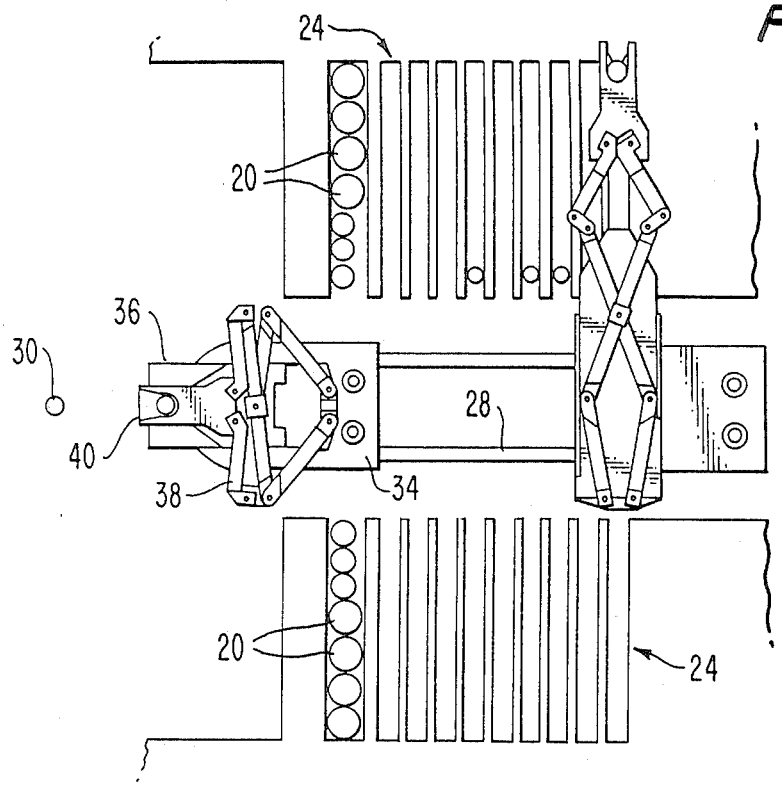
FIG. 3 is a view from above of the upper storage rack and the corresponding mechanisms of the installation.

It can be seen in FIGS. 2 and 3, that the mechanisms for grasping and transporting triples provided at the upper level comprise a carriage 34 displaceable in back-and-forth straight line movement on the roller track 28, and bearing a platform 36 which is movable in rotation around a vertical axis with respect to the carriage 34. On the platform 36 is mounted a telescoping arm 38 formed of horizontal girders, joined to one another to constitute two successive deformable parallelograms, and terminating with an automatic pincer 40 suited to engage, with some free play, a portion of a drilling shaft 20 suspended by the lifting mechanisms 16, 18. This automatic pincer is represented in detail in FIG. 4, and will be described below.

The mechanisms according to the invention which are provided on the floor 12 of the drilling tower also include a carriage 42 displaceable along the roller track 32, a platform 44 movable in rotation around a vertical axis on the carriage 42, a horizontal telescoping arm 46 mounted on the platform 44, and a carriage 48 connected to the moving end of the telescoping arm 46, and bearing a cradle 50 to receive the lower end of a drilling shaft. The telescoping arm 46 is represented in detail with the platform 42 in FIGS. 5 and 6, and the carriage 48 with the cradle 50 are represented in detail in FIGS. 7 to 9.

The installation also comprises a fixed apparatus represented in FIGS. 10 and 11, situated about 1.50 meters above the floor of the drilling tower, and comprising mechanisms for automatic grasping and guidance of the lower portion of a triple suspended by lifting mechanisms 16, 18, while the triple is brought into an oblique position, as will be seen below.

Figure 4:
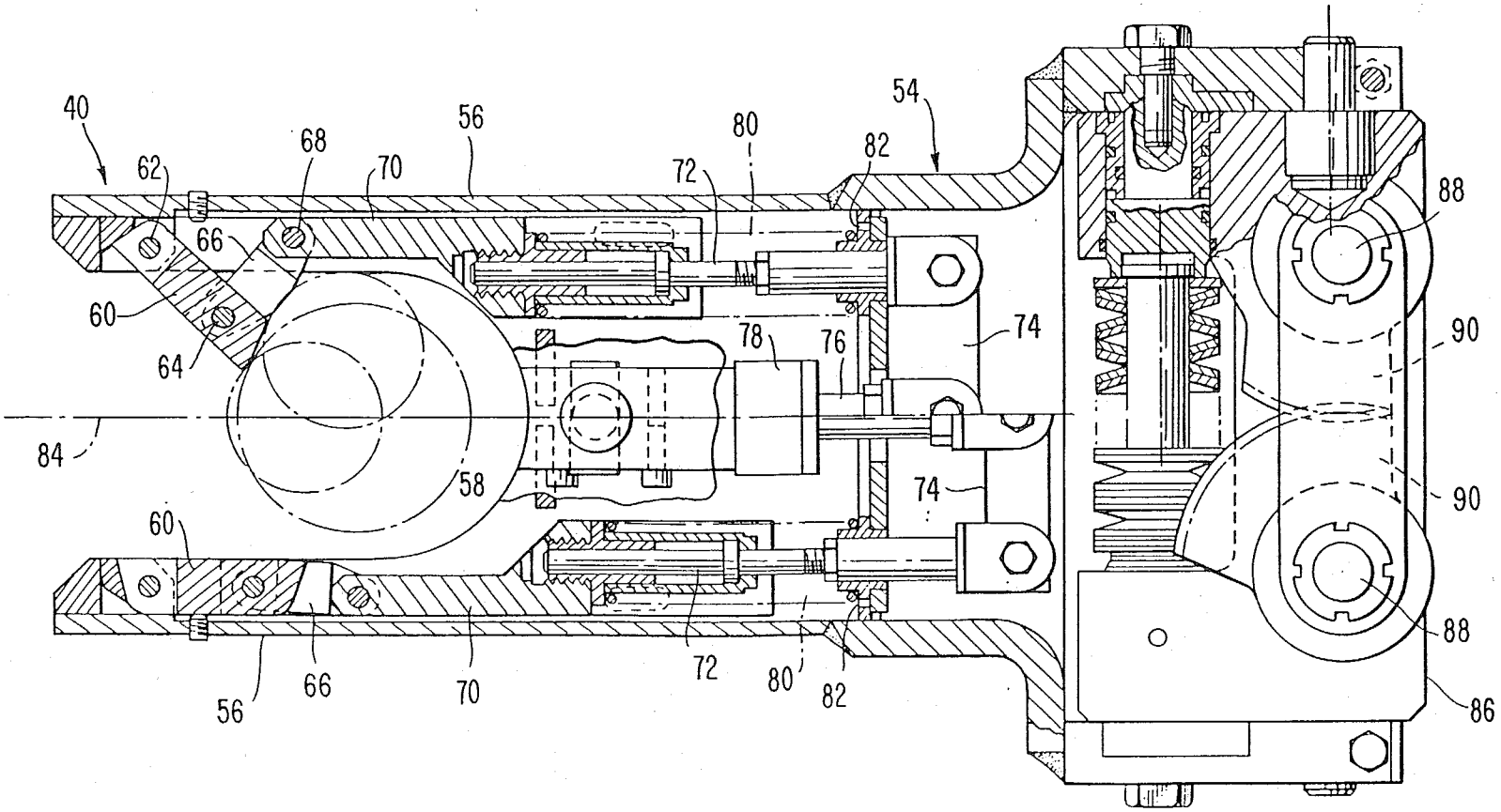
FIG. 4 is a larger scale cross-section view of the automatic pincer mounted at the end of the upper telescoping arm.

Referring now to FIG. 4, representing in detail, in horizontal section, the automatic pincer 40 mounted at the moving end of the upper telescoping arm 38, this pincer 40 comprises a chassis 54 connected by one end to the telescoping arm 38, and with the other end forming a fork with two horizontal prongs, between which can be engaged a vertical shaft section 20. The two prongs 56 of the fork are adapted to one another by a concave semicylindrical support surface 58, having a diameter greater than that of the screw bosses of the shaft sections 20. Each prong 56 is equipped with mechanisms to retain a shaft section, consisting of a first bar 60 hinged at one end around a vertical axis 62 at the forward end of the prong 56, and hinged around a vertical axis 64 in the vicinity of its other end, at the end of a second bar 66, whose other end is hinged around a vertical axis 68 at the forward end of a slide block 70 guided in horizontal displacement along the prong 56. The rear end of the slide block 70 is fixed by a shaft 72 to a lateral end of a transverse horizontal bar 74, whose central portion is connected to the piston shaft 76 of a horizontal hydraulic jack 78, the body of which is fixed to the chassis 54, behind the semicylindrical support surface 58, and extends along the axis of the fork formed by the two prongs 56. A compression spring 80 is placed around the shaft 72 between the rear end of the slide block 70 and a fixed stop 82, in order to push the slide block constantly toward the open forward end of the fork. In this position, the two bars 60 and 66 form a horizontal V opening into the space defined between the two prongs 56 of the fork, with the vertex of the V oriented toward the median axis 84 of the fork. This position is represented in the upper half of FIG. 4.

On the other hand, when the jack 78 is powered, to displace the piston shaft 76 rearward, the transverse bar 74 displaces the slide block 70 rearward, through the intermediary of the shaft 72, and the two bars 60 and 66 are aligned along the internal face of the prong 56, this position being represented in the lower half of FIG. 4.

The two retaining mechanism assemblies formed by the bars 60 and 66 are maneuvered by the same hydraulic jack 78, in such a way that when the piston shaft 76 is outside of the body of the jack 78, the bars 60 and 66 outfitting the two prongs 56 of the fork are in a position along the prongs, and when the piston shaft 76 is retracted within the body of the jack, these bars 60 and 66 are extended between the two prongs of the fork, with the rear ends of the two bars 60 forming abutment surfaces enabling retention of a shaft 20 introduced between the prongs of the fork, and preventing it from coming out. These retaining mechanisms are self-locking, such that to free a shaft 20 grasped by the pincer 40, it is necessary to power the jack 78 in the direction of extension of the piston shaft 76. On the other hand, when the pincer 40 is displaced in the direction of a drill shaft positioned in front of the prongs 56 of the fork, the force exerted by this shaft on the bars 60 in oblique position is sufficient to overcome the force exerted by the compression springs 80, so that the bars 60 are pushed back by the drill shaft toward the inner surfaces of the corresponding prongs 56 of the fork, to allow the drill shaft to penetrate between the prongs of the fork in the direction of the support surface 58, after which the bars 60 and 66 automatically return to the blocking position, under the effect of the springs 80, and the drill shaft 20 remains imprisoned by the automatic pincer 40.

The chassis 54 of the pincer is mounted at its rear on a piece 86 comprising two vertical arbors 88 fixed to the end girders of the telescoping arm 38. These vertical arbors 88 are each fixedly connected to a toothed sector 90, these two toothed sectors engaging one another, such that deployment and retraction of the telescoping arm 38 is constituted by a rectilinear movement of the automatic pincer 40 along the axis 84.

Figure 5:
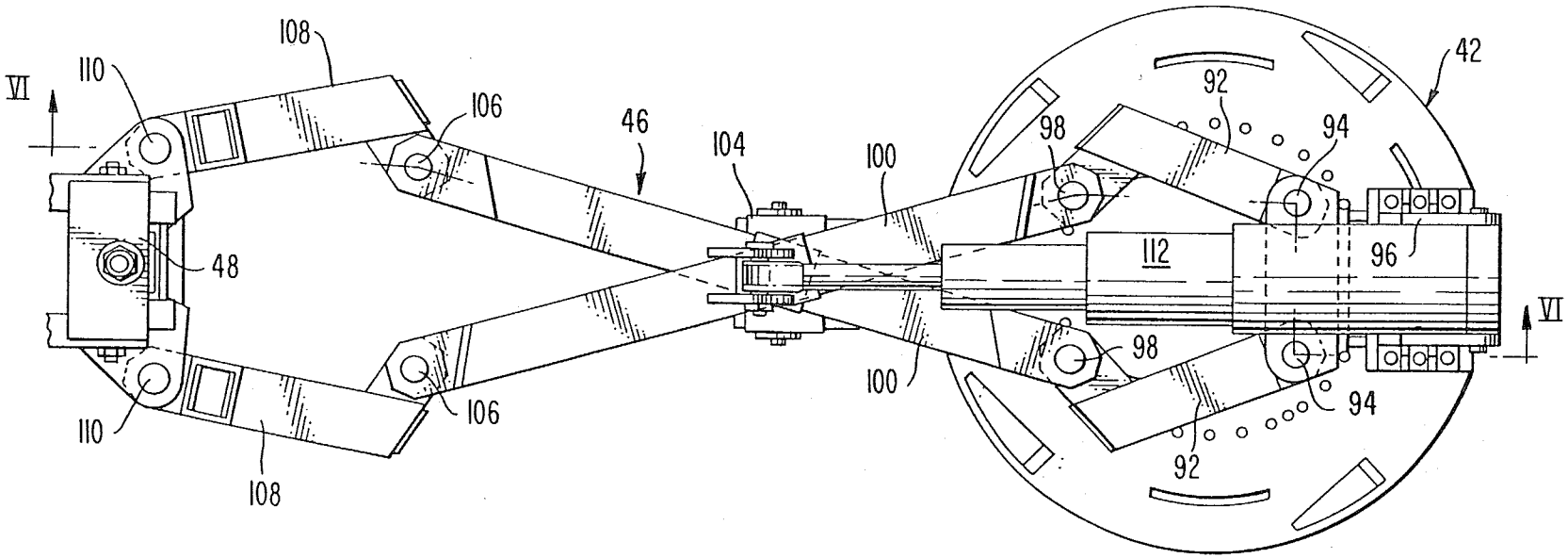
FIG. 5 is a view from above of the telescoping arm for displacement of the lower carriage.
Figure 6:
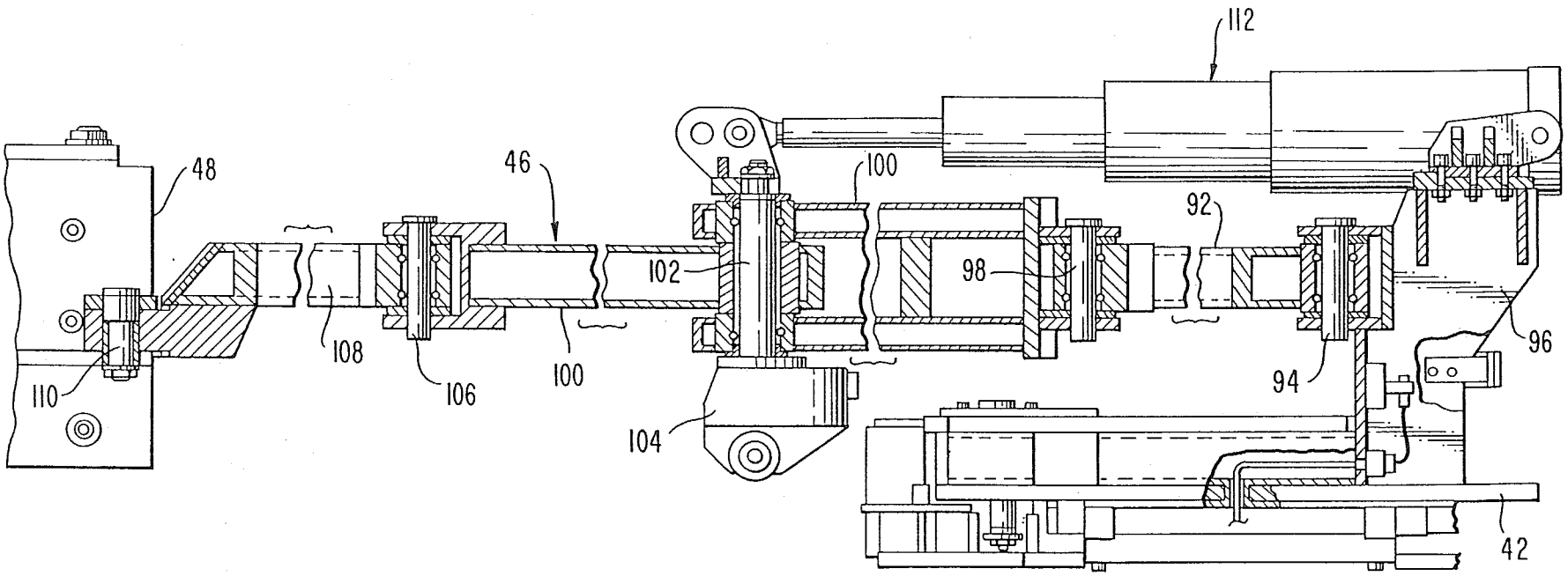
FIG. 6 is a section view along the line VI—VI of the telescoping arm of FIG. 5.

Reference will now be made to FIGS. 5 and 6, representing the telescoping arm 46 for displacement of the lower carriage 48. This telescoping arm comprises two rear girders 92 whose rear ends are mounted to pivot around vertical axes 94, contained in the same vertical transverse plane, on a chassis 96 fixedly mounted to the platform 42. The girders 92 each have a V-shape with an obtuse angle at the peak, and with branches of unequal length, with the longer branch mounted to pivot at its rear on the axis 94, while the shorter branch is mounted to pivot at its forward end around a vertical axis 98 on the rear end of an intermediary straight girder 100. The two girders 100 cross at their medial region, and are mounted to pivot around a common vertical axis 102 supported by a carriage 104. The forward ends of the intermediary girders 100 are connected to pivot around vertical axes 106 at the rear end of forward girders 108 which have essentially the same form as the rear girders 92. The foward ends of the girders 108 are mounted to pivot around vertical axes 110 on the carriage 48.

The telescoping arm 46 is thus constituted of two successive deformable parallellograms, the first of which is constituted by the rear girders 92 and the rear portions of the intermediary girders 100, and the second of which is constituted by the forward portions of the intermediary girders 100 and the forward girders 108.

A compound hydraulic jack 112, of the telescoping type with several stages in series, is mounted between the chassis 96 and the carriage 104 for the deployment and retraction of the telescoping arm 46, with the axis of the jack being horizontal and contained within the longitudinal vertical plane of symmetry of the arm 46.

Figure 7:
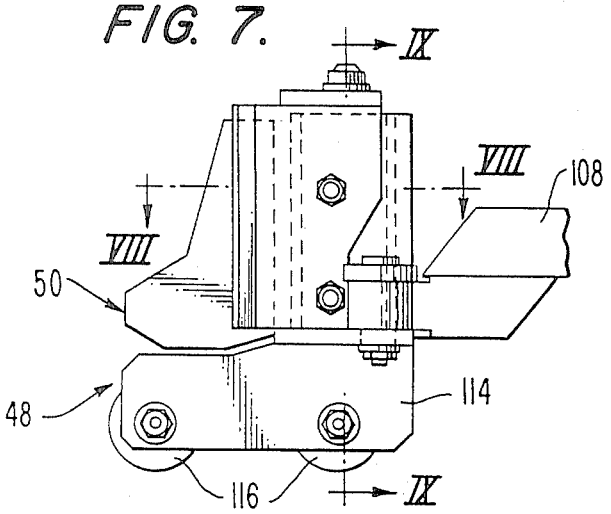
FIG. 7 is a surface view of the carriage mounted at the end of this arm.
Figure 9:
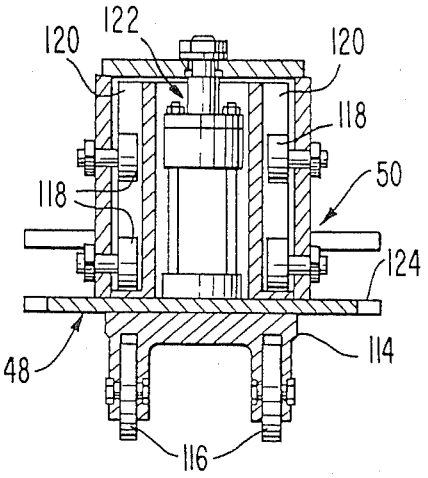
FIG. 9 is a section view along the line IX—IX of the carriage of FIG. 7.
Figure 8:
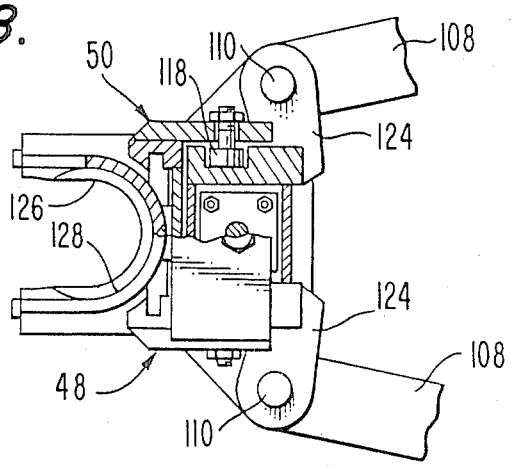
FIG. 8 is a view from above, and in partial cross-section along the line VIII—VIII of FIG. 7.

Reference is now made to FIGS. 7, 8 and 9, representing the carriage 48 and the cradle 50 provided at the end of the telescoping arm 46. The carriage 48 comprises a chassis 114 equipped with two pairs of wheels 116, front and rear, on which the cradle 50 is guided in vertical displacement by means of rollers 118 received within vertical grooves 120 of the two lateral faces of the chassis 114. A hydraulic jack 122 with vertical axis is supported by the chassis 114 for the vertical displacement of the cradle 50 with respect to the carriage 48 over a predetermined distance, of the order of 80 millimeters. The chassis 114 of the carriage 48 also comprises two lateral ears 124, on which are mounted the ends of the forward girders 108 of the arm 46, to pivot around vertical axes 110.

The cradle 50 forms a fork oriented forward, delimiting a horizontal C-shaped seat 126, intended to engage around the male boss of the lower end of a drill shaft 20, and to be raised to surround the base of the enlarged alignment section of the shaft 20. A cylindrical wall 128 with vertical axis which surrounds the horizontal seat 128, extends over more than 180°, so that the base of the enlarged portion of the drill shaft 20 can be retained by the cradle 50.

Figure 10:
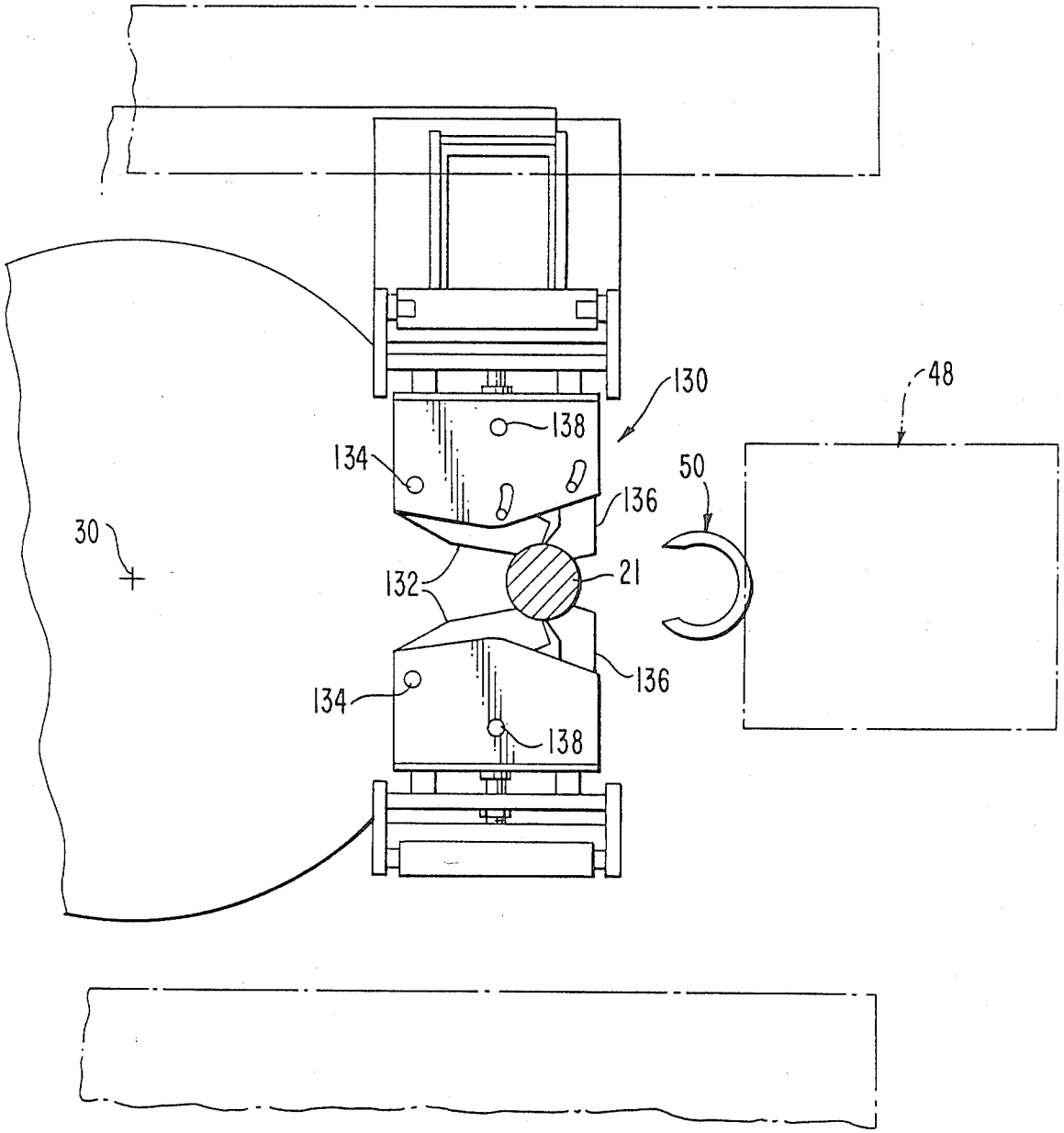
FIG. 10 is a view from above of the fixed retaining and guiding mechanism of the lower portion of a shaft assembly.
Figure 11:
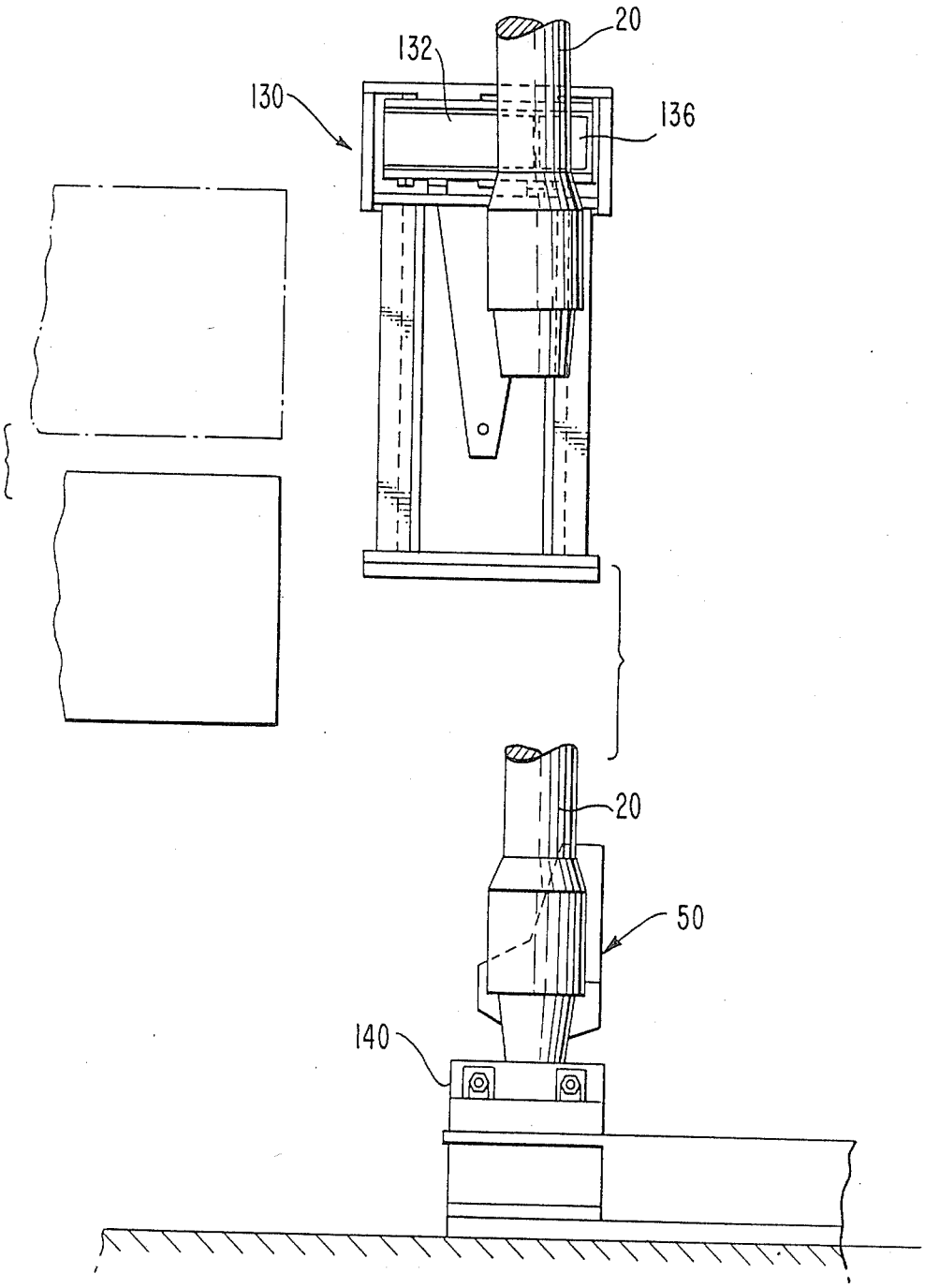
FIG. 11 is a surface view of this mechanism.

Referring now to FIGS. 10 and 11, which represent a fixed apparatus, mounted at a certain distance, for example 1.50 meters, above the floor of the drilling tower, this apparatus 130 defines a forced passage of a drill shaft 20, and comprises two entry jaws 132 mounted to pivot around vertical axes 134 on the chassis of the apparatus 130, and two exit jaws 136, mounted to pivot around vertical axes 138 on this chassis. The entry jaws 132 and exit jaws 136 are associated with return springs drawing them constantly into the position represented in FIG. 10. In this position, they form a mechanism for retention of a drilling shaft 20 engaged between them. These jaws are also associated with hydraulic jacks enabling them to be separated from one another to free the drilling shaft 20.

The jaws 132 and 136 define between them a corridor for guiding and receiving of a drilling shaft, with this corridor being open at its two ends, and oriented, on the one hand, toward the drilling axis 30, and, on the other hand, toward the principal axis of displacement of the carriage 46.

Below the apparatus 130, the floor of the drilling tower bears a footing 140 for support of the lower end of a drilling shaft, which is offset slightly rearward with respect to the vertical of the apparatus 130.

Next will be described the functioning of the installation according to the invention.

In a first time period, a triple 26 formed by three drill shaft sections 20 screwed end to end is removed from the drill bore by the lifting mechanism 16, 18. The shaft train remaining in the bore is blocked at the level of the floor 12, and the automatic pincer 40 borne by the telescoping arm 38 at the upper level is advanced towards the triple, which is still within the bore axis. As seen in reference to FIG. 4, the mechanisms 60, 66 of retention of the drill shaft section within the automatic pincer 40 automatically clamp when the pincer is advanced on the drilling shaft, then return to the locked position to retain the shaft section 20 within the pincer. The pincer grasps the triple essentially at the level of the junction between the upper shaft section 20 and the intermediate shaft section, that is, about 9 meters below the lifting mechanism 16, 18.

The triple is then detached, by unscrewing, from the upper end of the shaft train remaining within the bore. The triple 26 is thus suspended freely by the lifting mechanism 16, 18, still within the axis of the drill bore. Then the pincer is displaced to the rear, by retraction of the telescoping arm 38, to bring the triple into an oblique position with respect to the vertical, as represented in FIG. 2. In the course of this inclining of the triple, its lower end engages in the fixed apparatus 130, with a sufficient kinetic energy to push outward the entry jaws 132, and abut the exit jaws 136, without being able to push them outward. The triple 26 is thus maintained in an oblique position by the pincer 40 and by the apparatus 130.

Then the lifting mechanisms 16, 18 are lowered, to cause the triple to slide within the pincer 40 and the apparatus 130, and to bring its lower end onto the support footing 140.

The lifting mechanisms 16, 18 are then disengaged from the upper end of the triple 26, the lower carriage 48 is displaced toward the lower end of the triple, until the cradle 50 becomes engaged around its lower end, and the automatic pincer 40 is displaced toward the rear, to bring the triple to the vertical of the support footing 140. The cradle 50 borne by the carriage is raised with respect to the carriage until it grasps and surrounds the base of the enlarged portion of the lower end of the triple, and to lift the triple from the support footing. The jaws 136 of the apparatus 130 are opened at the desired moment, by means of the control hydraulic jacks, after which the upper and lower carriages and their telescoping arms are controlled synchronously to displace the triple toward the desired emplacements of the upper and lower racks. The turning platforms bearing the upper and lower telescoping arms enable access to all the storage points of these racks.

When the triple is in the desired position, the cradle 50 is lowered onto the lower carriage 48, to bring the lower end of the triple to rest against a support surface, the automatic pincer 40 is opened by powering the hydraulic jack 78, the automatic pincer 40 is disengaged from the upper portion of the triple, and the cradle 50 from its lower portion, after which the automatic pincer 40 and carriage 48 can be brought toward another triple just removed from the bore by the lifting mechanism.

The process continues in similar fashion, executing the above-cited operations in the inverse order, to take a triple from the storage racks, and bring it to the well bore.

The invention enables manipulation of triples in rapid and secure fashion between the well bore and the storage racks on a drilling tower, avoiding the manual interventions of the prior technology.

I claim:

1. A method for vertically storing drill shafts in upper and lower racks on a well bore drilling tower, comprising the steps of operating lifting means to lift an assembly of shaft sections attached end to end from the well bore, detaching the assembly of shaft sections from a shaft train remaining within the well bore, grasping an intermediate upper portion of the assembly with pincer means, displacing the pincer means to incline the shaft assembly relative to vertical while the shaft assembly is suspended by the lifting means and to bring a lower end of the shaft assembly above a support carriage, causing the lifting means to lower the inclined shaft assembly toward the support carriage, supporting the lower end of the shaft assembly on the support carriage, freeing the shaft assembly from the lifting means, displacing the pincer means and the support carriage in such a manner that the shaft assembly is returned to vertical and transported to locate its ends in corresponding emplacements of the upper and lower racks of the drilling tower, and disengaging the pincer means and the support carriage from the shaft assembly, which is thus deposited in the support racks.

2. A method according to claim 1, wherein said step of displacing the pincer means and the support carriage includes displacing the pincer means to return the inclined shaft assembly to vertical and then simultaneously displacing the pincer means and the support carriage to transport the shaft assembly vertically to locate its ends in said corresponding emplacements.

3. A method according to claim 2, including guiding the inclined shaft assembly within a retaining and guiding mechanism during lowering of the shaft assembly by the lifting means.

4. A method according to claim 2, wherein the inclined shaft assembly is lowered onto a support footing and wherein said supporting step includes engaging a fork-like cradle of the support carriage around the lower end of the shaft assembly, beneath an enlargement of the assembly, raising the cradle with respect to the carriage to lift the shaft assembly from the support footing, and releasing the shaft assembly from the retaining and guiding mechanism.

5. A method according to claim 1, wherein the aforesaid steps are executed conversely and in reverse order to return the shaft assembly from the storage racks to the well bore.

* * * * *